US008353765B2

(12) United States Patent
Goldschmidt

(10) Patent No.: US 8,353,765 B2
(45) **Date of Patent: *Jan. 15, 2013**

(54) GAMING MACHINE AND SYSTEM HAVING SECONDARY GAME

(75) Inventor: Thomas Goldschmidt, Henderson, NV (US)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/353,138

(22) Filed: Jan. 18, 2012

(65) Prior Publication Data

US 2012/0122568 A1 May 17, 2012

Related U.S. Application Data

(63) Continuation of application No. 12/613,989, filed on Nov. 6, 2009, now Pat. No. 8,162,748.

(51) Int. Cl.
*A63F 9/24* (2006.01)

(52) U.S. Cl. ..... 463/29; 463/25

(58) Field of Classification Search ..... 463/25, 463/29

See application file for complete search history.

(56) References Cited

U.S. PATENT DOCUMENTS

| | | | | |
|---|---|---|---|---|
| 7,438,640 | B2 * | 10/2008 | Amour | 463/25 |
| 8,065,212 | B2 * | 11/2011 | Amour | 705/35 |
| 2006/0014579 | A1 * | 1/2006 | Kane et al. | 463/17 |
| 2007/0287533 | A1 * | 12/2007 | Amour | 463/26 |
| 2008/0102946 | A1 * | 5/2008 | Amour | 463/29 |
| 2009/0098934 | A1 * | 4/2009 | Amour | 463/25 |
| 2009/0143133 | A1 | 6/2009 | Baerlocher | |

* cited by examiner

*Primary Examiner* — Pierre E Elisca
(74) *Attorney, Agent, or Firm* — Howard & Howard Attorneys PLLC

(57) ABSTRACT

A gaming system comprises a plurality of gaming machines (EGMs) and a secondary game control section. The secondary game control section is provided with a plurality of data sets having different target investment amount between two triggerings of the secondary game. The secondary game control section is adapted to receive a bet contribution from each of the EGMs and calculate an average bet amount from the received bet contributions. The secondary game control section selects one of the data sets depending on the calculated average bet amount, and determines whether the secondary game is triggered for each bet contribution from the EGMs using the target investment amount associated with the selected one of the data sets and a random number, and if it is determined that the secondary game is triggered, pays out a secondary game award to an EGM of which bet contribution triggered the secondary game.

17 Claims, 18 Drawing Sheets

| # Base bets wagered | 0.1 | 0.2 | 0.5 | 0.66667 | 1 | 2 | 3 |
|---|---|---|---|---|---|---|---|
| Average bet per hour | $15 | $30 | $75 | $100 | $150 | $300 | $450 |
| Hit Frequency in minutes | 200.0 | 100.0 | 40.0 | 30.0 | 20.0 | 10.0 | 6.7 |
| Set used | 1 | 1 | 1 | 1 | 1 | 1 | 1 |
| Hit Frequency in minutes set 2 | 800.0 | 400.0 | 160.0 | 120.0 | 80.0 | 40.0 | 26.7 |

| # Base bets wagered | 4 | 5 | 6 | 7 | 8 | 9 | 10 | 15 |
|---|---|---|---|---|---|---|---|---|
| Average bet per hour | $600 | $750 | $900 | $1,050 | $1,200 | $1,350 | $1,500 | $2,250 |
| Hit Frequency in minutes | 20.0 | 16.0 | 13.3 | 11.4 | 10.0 | 8.9 | 8.0 | 5.3 |
| Set used | 2 | 2 | 2 | 2 | 2 | 2 | 2 | 2 |
| Hit Frequency in minutes set 2 | 20.0 | 16.0 | 13.3 | 11.4 | 10.0 | 8.9 | 8.0 | 5.3 |

| # Base bets wagered | 16 | 20 | 32 | 40 | 80 | 100 | 200 |
|---|---|---|---|---|---|---|---|
| Average bet per hour | $2,400 | $3,000 | $4,800 | $6,000 | $12,000 | $15,000 | $30,000 |
| Hit Frequency in minutes | 20.0 | 16.0 | 10.0 | 8.0 | 4.0 | 3.2 | 1.6 |
| Set used | 3 | 3 | 3 | 3 | 3 | 3 | 3 |
| Hit Frequency in minutes set 2 | 5.0 | 4.0 | 2.5 | 2.0 | 1.0 | 0.8 | 0.4 |

Figure 4A

Selection Table

| Set% | 1 | 2 | 3 |
|---|---|---|---|
| Min Cutoff AVG bet per hour | $0.00 | $600.00 | $2,400.00 |
| Max Cutoff AVG bet per hour | $599.99 | $2,399.99 | $999,999.99 |
| Trigger amount | $50.00 | $200.00 | $800.00 |
| 80% Distribution | $40.00 | $160.00 | $640.00 |

| Set 1 | RESET | INC. % | CYCLE | Weight | RESET % | Distrib% | Av.Jackpot |
|---|---|---|---|---|---|---|---|
| MAXI | $1,000 | 10.0000% | 294.00 | 1 | 6.8027% | 0.34% | $2,470.00 |
| MEGA | $200 | 10.0000% | 58.80 | 8 | 6.8027% | 1.70% | $494.00 |
| MAJOR | $50 | 10.0000% | 11.76 | 25 | 8.5034% | 8.50% | $108.80 |
| MINI | $10 | 10.0000% | 1.12 | 263 | 17.8912% | 89.46% | $15.59 |
| | TOTAL | 40.0000% | SUM: | 294 | 40.0000% | 100.00% | |
| AVG. Trigger Amount: | $50 | | PAYOUT%: | 80.0000% | | | |

Figure 4B

| Set 2 | RESET | INC. % | CYCLE | Weight | RESET % | Distrib% | Av.Jackpot |
|---|---|---|---|---|---|---|---|
| MAXI | $1,000 | 10.0000% | 50.43 | 5,000 | 9.9150% | 1.98% | $2,008.57 |
| MEGA | $200 | 10.0000% | 5.04 | 50,000 | 19.8300% | 19.83% | $300.86 |
| MAJOR | $50 | 10.0000% | 3.15 | 80,000 | 7.9320% | 31.73% | $113.04 |
| MINI | $10 | 10.0000% | 2.15 | 117,143 | 2.3229% | 46.46% | $53.05 |
| | TOTAL | 40.0000% | SUM: | 252,143 | 40.0000% | 100.00% | |
| AVG. Trigger Amount: | $200 | | PAYOUT%: | 80.0000% | | | |

| Set 3 | RESET | INC. % | CYCLE | Weight | RESET % | Distrib% | Av.Jackpot |
|---|---|---|---|---|---|---|---|
| MAXI | $1,000 | 10.0000% | 3.86 | 100,000 | 32.3726% | 25.90% | $1,308.90 |
| MEGA | $200 | 10.0000% | 4.29 | 90,000 | 5.8271% | 23.31% | $543.23 |
| MAJOR | $50 | 10.0000% | 4.29 | 90,000 | 1.4568% | 23.31% | $393.23 |
| MINI | $10 | 10.0000% | 3.64 | 106,129 | 0.3436% | 27.49% | $301.06 |
| | TOTAL | 40.0000% | SUM: | 386,129 | 40.0000% | 100.00% | |
| AVG. Trigger Amount: | $800 | | PAYOUT%: | 80.0000% | | | |

Figure 4C

| # Base bets wagered | 0.1 | 0.2 | 0.5 | 0.66667 | 1 | 2 | 3 |
|---|---|---|---|---|---|---|---|
| Average bet per hour | $15 | $30 | $75 | $100 | $150 | $300 | $450 |
| Hit Frequency in minutes | 200.0 | 100.0 | 40.0 | 30.0 | 20.0 | 10.0 | 6.7 |
| Set used | 1 | 1 | 1 | 1 | 1 | 1 | 1 |
| Hit Frequency in minutes set 2 | 800.0 | 400.0 | 160.0 | 120.0 | 80.0 | 40.0 | 26.7 |

| # Base bets wagered | 4 | 5 | 6 | 7 | 8 | 9 | 10 | 15 |
|---|---|---|---|---|---|---|---|---|
| Average bet per hour | $600 | $750 | $900 | $1,050 | $1,200 | $1,350 | $1,500 | $2,250 |
| Hit Frequency in minutes | 20.0 | 16.0 | 13.3 | 11.4 | 10.0 | 8.9 | 8.0 | 5.3 |
| Set used | 2 | 2 | 2 | 2 | 2 | 2 | 2 | 2 |
| Hit Frequency in minutes set 2 | 20.0 | 16.0 | 13.3 | 11.4 | 10.0 | 8.9 | 8.0 | 5.3 |

| # Base bets wagered | 16 | 20 | 32 | 40 | 80 | 100 | 200 |
|---|---|---|---|---|---|---|---|
| Average bet per hour | $2,400 | $3,000 | $4,800 | $6,000 | $12,000 | $15,000 | $30,000 |
| Hit Frequency in minutes | 20.0 | 16.0 | 10.0 | 8.0 | 4.0 | 3.2 | 1.6 |
| Set used | 3 | 3 | 3 | 3 | 3 | 3 | 3 |
| Hit Frequency in minutes set 2 | 5.0 | 4.0 | 2.5 | 2.0 | 1.0 | 0.8 | 0.4 |

Figure 5A

Selection Table

| Set% | 1 | 2 | 3 |
|---|---|---|---|
| Min Cutoff AVG bet per hour | $0.00 | $600.00 | $2,400.00 |
| Max Cutoff AVG bet per hour | $599.99 | $2,399.99 | $999,999.99 |
| Trigger amount | $50.00 | $200.00 | $800.00 |
| 80% Distribution | $40.00 | $160.00 | $640.00 |

| Set 1 | RESET | INC. % | CYCLE | Weight | RESET % | Distrib% | Av.Jackpot |
|---|---|---|---|---|---|---|---|
| MAXI | $10,000 | 2.0000% | 1584.00 | 1 | 12.6263% | 0.06% | $11,584.00 |
| MEGA | $1,000 | 4.0000% | 144.00 | 11 | 13.8889% | 0.69% | $1,288.00 |
| MAJOR | $100 | 6.0000% | 13.20 | 120 | 15.1515% | 7.58% | $139.60 |
| MINI | $10 | 8.0000% | 1.09 | 1,452 | 18.3333% | 91.67% | $14.36 |
| | TOTAL | 20.0000% | SUM: | 1,584 | 60.0000% | 100.00% | |
| AVG. Trigger Amount: | $50 | | PAYOUT%: | 80.0000% | | | |

Figure 5B

| Set 2 | RESET | INC. % | CYCLE | Weight | RESET % | Distrib% | Av.Jackpot |
|---|---|---|---|---|---|---|---|
| MAXI | $10,000 | 2.0000% | 156.29 | 1,600 | 31.9927% | 0.64% | $10,625.14 |
| MEGA | $1,000 | 4.0000% | 31.26 | 8,000 | 15.9964% | 3.20% | $1,250.06 |
| MAJOR | $100 | 6.0000% | 6.25 | 40,025 | 8.0032% | 16.01% | $174.97 |
| MINI | $10 | 8.0000% | 1.25 | 200,432 | 4.0077% | 80.15% | $29.96 |
| | TOTAL | 20.0000% | SUM: | 250,057 | 60.0000% | 100.00% | |
| AVG. Trigger Amount: | $200 | | PAYOUT%: | 80.0000% | | | |

| Set 3 | RESET | INC. % | CYCLE | Weight | RESET % | Distrib% | Av.Jackpot |
|---|---|---|---|---|---|---|---|
| MAXI | $10,000 | 2.0000% | 29.35 | 1,750 | 42.5857% | 3.41% | $10,469.64 |
| MEGA | $1,000 | 4.0000% | 8.56 | 6,000 | 14.6008% | 11.68% | $1,273.96 |
| MAJOR | $100 | 6.0000% | 6.42 | 8,000 | 1.9468% | 15.57% | $408.20 |
| MINI | $10 | 8.0000% | 1.44 | 35,617 | 0.8667% | 69.34% | $102.30 |
| | TOTAL | 20.0000% | SUM: | 51,367 | 60.0000% | 100.00% | |
| AVG. Trigger Amount: | $800 | | PAYOUT%: | 80.0000% | | | |

Figure 5C

| # Base bets wagered | 1 | 2 | 3 | 4 | 5 | 6 | 7 | 8 | 9 | 10 | 15 |
|---|---|---|---|---|---|---|---|---|---|---|---|
| Average bet amount per Spin | $0.25 | $0.50 | $0.75 | $1.00 | $1.25 | $1.50 | $1.75 | $2.00 | $2.25 | $2.50 | $3.75 |
| Trigger frequency (games played) | 200 | 100 | 67 | 200 | 160 | 133 | 114 | 100 | 89 | 80 | 53 |
| Set used | 1 | 1 | 1 | 2 | 2 | 2 | 2 | 2 | 2 | 2 | 2 |
| Trigger frequency Set 2 | 800 | 400 | 267 | 200 | 160 | 133 | 114 | 100 | 89 | 80 | 53 |

| # Base bets wagered | 16 | 20 | 32 | 40 | 80 | 100 | 200 |
|---|---|---|---|---|---|---|---|
| Average bet amount per Spin | $4.00 | $5.00 | $8.00 | $10.00 | $20.00 | $25.00 | $50.00 |
| Trigger frequency (games played) | 200 | 160 | 100 | 80 | 40 | 32 | 16 |
| Set used | 3 | 3 | 3 | 3 | 3 | 3 | 3 |
| Trigger frequency Set 2 | 50 | 40 | 25 | 20 | 10 | 8 | 4 |

Figure 6A

Selection Table

| Set% | 1 | 2 | 3 |
|---|---|---|---|
| Min Cutoff AVG bet per hour | $0.00 | $1.00 | $4.00 |
| Max Cutoff AVG bet per hour | $0.99 | $3.99 | $999.99 |
| Trigger amount | $50.00 | $200.00 | $800.00 |
| 80% Distribution | $40.00 | $160.00 | $640.00 |

| Set 1 | RESET | INC. % | CYCLE | Weight | RESET % | Distrib% | Av.Jackpot |
|---|---|---|---|---|---|---|---|
| MAXI | $1,000 | 10.0000% | 294.00 | 1 | 6.8027% | 0.34% | $2,470.00 |
| MEGA | $200 | 10.0000% | 58.80 | 5 | 6.8027% | 1.70% | $494.00 |
| MAJOR | $50 | 10.0000% | 11.76 | 25 | 8.5034% | 8.50% | $108.80 |
| MINI | $10 | 10.0000% | 1.12 | 263 | 17.8912% | 89.46% | $15.59 |
| | TOTAL | 40.0000% | SUM: | 294 | 40.0000% | 100.00% | |
| AVG. Trigger Amount: | $50 | | PAYOUT%: | 80.0000% | | | |

Figure 6B

| Set 2 | RESET | INC. % | CYCLE | Weight | RESET % | Distrib % | Av.Jackpot |
|---|---|---|---|---|---|---|---|
| MAXI | $1,000 | 10.0000% | 50.43 | 5,000 | 9.9150% | 1.98% | $2,008.57 |
| MEGA | $200 | 10.0000% | 5.04 | 50,000 | 19.8300% | 19.83% | $300.86 |
| MAJOR | $50 | 10.0000% | 3.15 | 80,000 | 7.9320% | 31.73% | $113.04 |
| MINI | $10 | 10.0000% | 2.15 | 117,143 | 2.3229% | 46.46% | $53.05 |
| | TOTAL | 40.0000% | SUM: | 252,143 | 40.0000% | 100.00% | |
| AVG. Trigger Amount: | $200 | | PAYOUT%: | 80.0000% | | | |

| Set 3 | RESET | INC. % | CYCLE | Weight | RESET % | Distrib % | Av.Jackpot |
|---|---|---|---|---|---|---|---|
| MAXI | $1,000 | 10.0000% | 3.86 | 100,000 | 32.3726% | 25.90% | $1,308.90 |
| MEGA | $200 | 10.0000% | 4.29 | 90,000 | 5.8271% | 23.31% | $543.23 |
| MAJOR | $50 | 10.0000% | 4.29 | 90,000 | 1.4568% | 23.31% | $393.23 |
| MINI | $10 | 10.0000% | 3.64 | 106,129 | 0.3436% | 27.49% | $301.06 |
| | TOTAL | 40.0000% | SUM: | 386,129 | 40.0000% | 100.00% | |
| AVG. Trigger Amount: | $300 | | PAYOUT%: | 80.0000% | | | |

Figure 6C

GAMING MACHINE AND SYSTEM HAVING SECONDARY GAME

CROSS REFERENCE TO RELATED APPLICATION

This application is a continuation of U.S. patent application Ser. No. 12/613,989, filed Nov. 6, 2009, which is incorporated herein by reference.

FIELD OF THE INVENTION

The present invention relates to gaming machines having a primary game and a secondary game for use in casinos, pachisuro slot machine parlors, etc., and gaming systems having a plurality of such gaming machines linked together. The present invention also relates to a method for conducting a game having a primary game and a secondary game.

BACKGROUND OF THE INVENTION

Slot machines are popular gaming machines in casinos. There are many types of slot machines and some of the slot machines, which may be referred to as mechanical slot machines or stepper machines, have mechanical reels each bearing a series of symbols thereon. Other slot machines, which may be referred to as video slot machines, have a display for displaying a plurality of cells or columns in which symbols (or indicia) are shown randomly in each game. When the symbols shown by the reels of the mechanical slot machines or shown in the cells or columns of the video slot machine form one or more winning combinations, a corresponding award is paid to the player.

Also, recent slot machines typically have a secondary game in addition to the primary game (or slot game). The secondary game is often called a bonus game and is initiated upon the occurrence of a selected event or outcome of the primary game, or may be triggered by a separate event that may or may not be connected to the primary game. For example, the secondary game may be triggered based on a random number generated by a random number generator separately from a random number generated for determining the outcome of the primary game.

The secondary game may include any type of game, either similar to or completely different from the primary game. For example, the secondary game may be embodied as a progressive game. As is well known in the art, in the progressive game, an award ("progressive award") paid out to the player consists of an award that has been updated or increased by accumulating a portion of the player's bet of the primary game. Typically, the progressive award comprises several levels having different reset values, on which the portion of the player's bet is accumulated. When a predetermined condition for winning the progressive award is met during a primary game, the progressive game is triggered to determine at least one of the several progressive levels that is paid out to the player as the award, and the value of the paid out progressive level is reset to its reset value. As mentioned above, the predetermined condition may be related to the outcome of the primary game or may be based on a selected event that may not be related to the outcome of the primary game.

There are many examples of the progressive game of the gaming machine. One of them is disclosed in U.S. Patent Application Publication No. 2009/0143133. The gaming device related to this Patent Application Publication is designed such that the gaming device enables an average investment necessary to win the progressive award (or jackpot) to be uniform by varying odds of winning the progressive award as the player's bet varies. That is, a player betting less money needs to play the game for a longer time, in general, to win the jackpot. Likewise, a player betting more money can reach the condition to start the progressive game to win the jackpot in a shorter time, in general. The average overall bet or investment thus remains constant despite the player's betting habits or betting ability.

As described above, the odds of winning the progressive award or a hit frequency for triggering the progressive game is determined based on a player's bet amount in the above conventional gaming device such that the average overall bet or investment necessary for winning the jackpot remains constant. That is, in order to maintain the average investment for winning the jackpot to be constant (for example, $200), the higher the player's average bet becomes (for example, $200/minute), the higher the hit frequency for triggering the progressive game becomes (for example, one time per one minute). Likewise, the lower the player's average bet becomes (for example, $0.5/minute), the lower the hit frequency for triggering the progressive game becomes (for example, one time per 400 minutes). Therefore, these conventional progressive systems have a problem that the hit frequency for triggering the progressive game can drastically change to such a degree that the hit frequency can be impractically high or low depending on the player's average bet. Especially, in a linked progressive system where a lot of gaming machines are connected so that a portion of the bets on these gaming machines is accumulated on the progressive levels, the hit frequency for triggering the progressive game may change even more drastically because the occupancy rate can change in a wide range throughout a day or a week and this significantly affects the average bet per game by the players. This problem is inherent in conventional math model and has not been solved so far. The present invention is aimed at one or more of the problems set forth above.

SUMMARY OF THE INVENTION

The present invention is made to solve the above problems in the conventional systems, and a primary object of the present invention is to provide a gaming system or gaming machine which can maintain the hit frequency for the secondary game within a prescribed range for a wide range of average bet amount from the players.

Another object of the invention is to provide such a gaming system or gaming machine that can guarantee a predetermined payout percentage (or return percentage) without need for complicated calculations.

Yet another object of the invention is to provide a gaming method which can maintain the hit frequency for the secondary game within a prescribed range for a wide range of average bet amount from the players.

To achieve the above objects, according to one aspect of the invention, there is provided a gaming system, comprising: a plurality of gaming machines each conducting a primary game; and a secondary game control section for conducting a secondary game, wherein: the secondary game control section is provided with a plurality of data sets having different target investment amount between two triggerings of the secondary game; the secondary game control section is adapted to receive a bet contribution from each of the plurality of gaming machines and calculate an average bet amount from the received bet contributions; the secondary game control section selects one of the data sets depending on the calculated average bet amount; and the secondary game control section determines whether the secondary game is triggered for each bet contribution from the plurality of gaming machines using the target investment amount associated with the selected one of the data sets and a random number, and if it is determined that the secondary game is triggered, pays out a secondary game award to a gaming machine of which bet contribution triggered the secondary game (or the player playing the gaming machine).

In this way, because the target investment amount corresponding to the selected data set is used in determining whether the secondary game is triggered for each bet contribution from the gaming machines contained in the gaming system, it is possible to select an appropriate value of target investment amount for the varying average bet amount and determine whether the secondary game is triggered by using the selected target investment amount, to thereby keep the hit frequency of the secondary game within a desired range for a wide range of average bet amount.

In one aspect of the present invention, the secondary game has a plurality of award levels and the plurality of data sets define odds of winning the plurality of award levels based on the respective target investment amounts and a predetermined payout percentage. In such a case, the secondary game control section determines which of the plurality of award levels is won according to the odds defined by the selected one of the data sets when it is determined that the secondary game is triggered.

Since the plurality of data sets define odds of winning the plurality of award levels based on the respective target investment amounts and a predetermined payout percentage, it can be ensured that the predetermined payout percentage is always achieved irrespective of which data set is used.

Typically, the secondary game is a progressive game and the plurality of award levels comprise at least one progressive level, and the plurality of data sets comprise parameters for defining an increment rate and reset value of the at least one progressive level according to which the secondary game control section calculates an amount of the at least one progressive level based on the bet contributions from the gaming machines.

In one preferred embodiment, the secondary game control section comprises: a first controller for calculating the average bet amount; and a second controller for selecting one of the data sets depending on the average bet amount and determining whether the secondary game is triggered using the target investment amount associated with the selected one of the data set. The second controller may have a plurality of controllers provided to respective gaming machines. In one embodiment, the average bet amount consists of an average bet amount per time period, which can be calculated in a variety of ways.

According to another aspect of the present invention, there is provided a gaming machine, comprising: a game control section for conducting a primary game and a secondary game, wherein: the game control section is provided with a plurality of data sets having different target investment amount between two triggerings of the secondary game; the game control section is adapted to calculate an average bet amount from bet contributions input by a player; the game control section selects one of the data sets depending on the calculated average bet amount; and the game control section determines whether the secondary game is triggered for each bet contribution using the target investment amount associated with the selected one of the data sets and a random number, and if it is determined that the secondary game is triggered, pays out a secondary game award to the player. It should be noted here that the paying out of the secondary game award to the player may include storing the amount of secondary game award in the gaming machine as data or actually outputting cash corresponding to the amount of secondary game award to the player.

Thus, the present invention is applicable not only to the gaming system comprising a plurality of gaming machines linked together but also to a single, stand-alone gaming machine to bring about similar advantages.

According to yet another aspect of the present invention, there is provided a method for conducting a game having a primary game and a secondary game in a system comprising a plurality of gaming machines, the method comprising the steps of: providing a plurality of data sets having different target investment amount between two triggerings of the secondary game; calculating an average bet amount from bet contributions input to the plurality of gaming machines by players; selecting one of the data sets depending on the calculated average bet amount; and determining whether the secondary game is triggered for each bet contribution from the plurality of gaming machines using the target investment amount associated with the selected one of the data sets and a random number, and if it is determined that the secondary game is triggered, paying out a secondary game award to a gaming machine of which bet contribution triggered the secondary game.

In such a method also, since the target investment amount corresponding to the selected data set is used in determining whether the secondary game is triggered for each bet contribution from the gaming machines contained in the gaming system, it is possible to select an appropriate value of target investment amount for the varying average bet amount and determine whether the secondary game is triggered by using the selected target investment amount, to thereby keep the hit frequency of the secondary game within a desired range for a wide range of average bet amount.

BRIEF DESCRIPTION OF THE DRAWINGS

Other and further objects, features and advantages of the invention will appear more fully from the following description with reference to the appended drawings, in which:

FIGS. 4A, 4B, 4C, and 4D comprise a data sheet illustrating an example of data sets according to the present invention;

FIGS. 5A, 5B, 5C, and 5D comprise a data sheet illustrating another example of data sets according to the present invention;

FIGS. 6A, 6B, 6C, and 6D comprise a data sheet illustrating yet another example of data sets according to the present invention;

DESCRIPTION OF THE PREFERRED EMBODIMENTS

Figure 1:
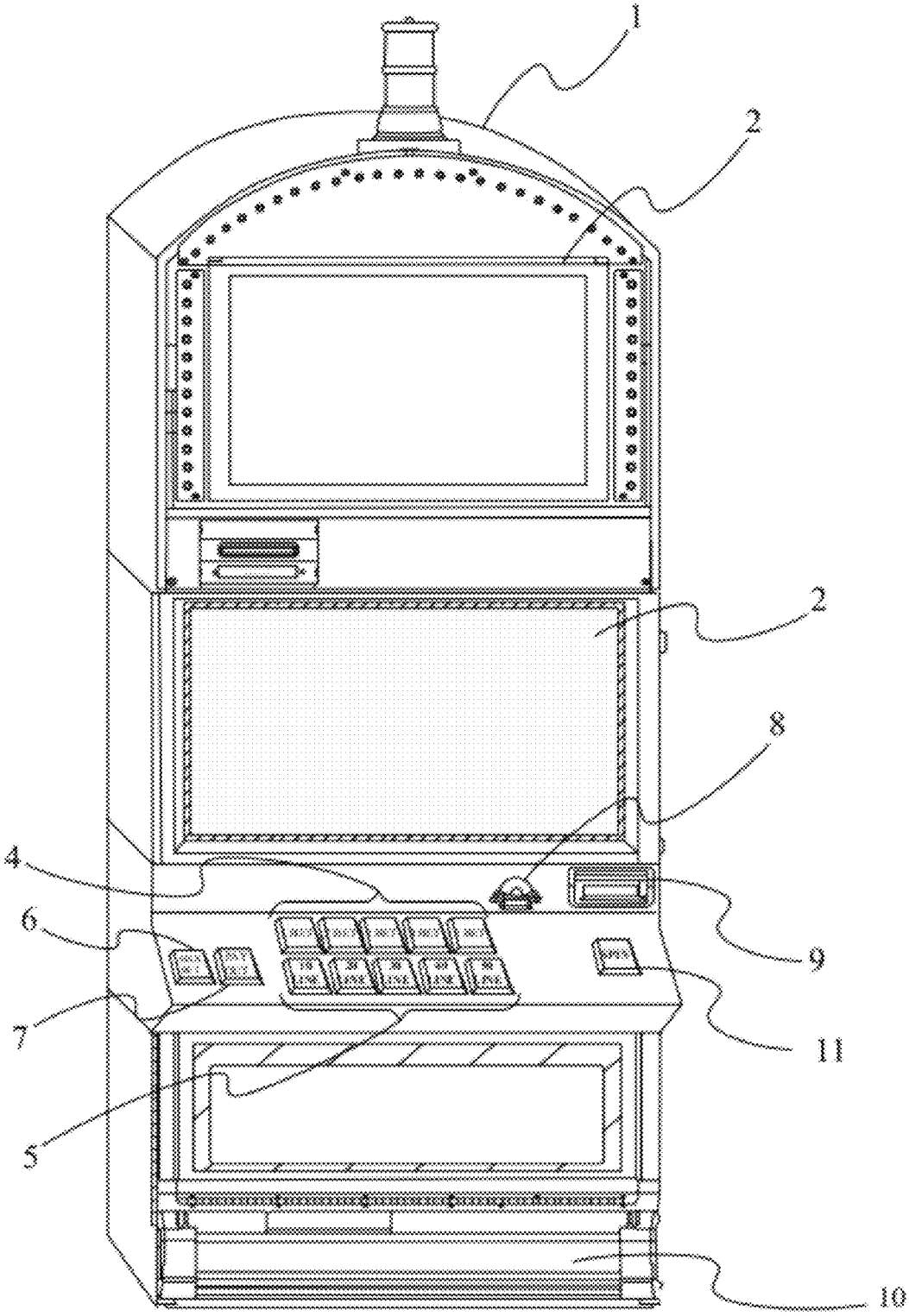
FIG. 1 is a perspective view illustrating an example of a gaming machine of the present invention.

FIG. 1 is a perspective view showing an example of a gaming machine of the present invention. The gaming machine 1 illustrated in FIG. 1 is designed as a video slot machine. As shown in FIG. 1, the gaming machine 1 is provided with two displays 2. Immediately under the displays 2, there are provided BET switches 4, line-selecting switches 5, a MAXBET switch 6, a PAYOUT switch 7, a coin slot 8, a bill acceptor 9 and a spin button 11. The BET switches 4 are provided for selecting a wager per pay line. In this embodiment, the gaming machine 1 includes five BET switches from 1BET to 5BET. The line-selecting switches 5 are provided to determine how many pay lines should be selected (or activated) in each slot game. In this embodiment, the gaming machine 1 includes five line-selecting switches from 10LINE to 50LINE. The spin button 11 may be used to start a slot game executed in the gaming machine 1. A coin payout mouth 10 is also provided in the lower part of the gaming machine 1. The above-mentioned components equipped in the gaming machine 1 may be used to execute a primary game and a secondary game on the display 2.

The "primary game" used in this specification means a game initiated on a gaming machine at first after the gaming machine receives a bet from a player and also a game most frequently executed in an entire game executed by the gaming machine. In general, the primary game may be any game such as a slot game, a poker game or a roulette game, though in the illustrated gaming machine (video slot machine) 1, the primary game consists of a slot game.

The "secondary game" used in this specification means a game secondly executed in an entire game executed in the gaming machine when a predetermined condition is satisfied. Whether the predetermined condition is satisfied or not may depend on a result of the primary game or may not depend on the result of the primary game. The secondary game is typically executed in order to provide a bonus to the player and therefore, it may be called "a bonus game". Thus, an award of the secondary game is usually higher than that of the primary game in average. Also, odds of winning in the secondary game are usually higher than in the primary game in average. The secondary game may be configured by the same kind of game as the primary game. For example, slot games may be executed both as the primary game and as the secondary game. Alternatively, the secondary game may be configured by a different kind of game from the primary game. For example, the secondary game may be a bingo game while the primary game may be a slot game. Typically, the secondary game is a free game, i.e., executed without receiving a bet from a player.

Referring back to FIG. 1, information required by the player to play a game is displayed on the displays 2. For example, such information may include symbols used in the slot game, selected wager per pay line, activated pay lines, etc. It should be noted that in general, the information provided by the displays 2 can change depending on the game that the gaming machine 1 provides. For example, if the gaming machine 1 is adapted to provide a card game, the information may include images of cards used by the card game, and if the gaming machine 1 is adapted to provide a roulette game, the information may include an image of the roulette used in the roulette game.

The information may also include an indication to prompt a player to make certain choices in a progressive game if the gaming machine 1 is adapted to provide a progressive game as the secondary game. The "progressive game" is a game having a progressive award which is gradually updated according to a player's bet. In general, the progressive game has some kinds of progressive awards (or progressive levels) having different reset values, and one of the progressive levels is selected to be paid out to a player if the player wins the progressive game. In such a case, the displays 2 may also display the amount of each kind of progressive levels that a player has a chance to obtain. Moreover, credit information that the player has input into the gaming machine 1 may be displayed on the display 2. A play history of the player may be displayed on the display 2 as well.

The progressive game can be classified either as a linked progressive game and a stand-alone progressive game. The linked progressive game means a progressive game configured by a plurality of network-linked gaming machines. In one embodiment, the progressive award of the linked progressive game is updated according to the bet amount that the plurality of network-linked gaming machines receive. On the other hand, the stand-alone progressive game means a progressive game conducted by a single gaming machine alone. The linked progressive game can be classified into a local area progressive game and a wide area progressive game. The local area progressive game means a progressive game executed by a plurality of gaming machines linked with each other within a certain casino. On the other hand, the wide area progressive game means a progressive game executed by a plurality of linked gaming machines located within a plurality of casinos.

As mentioned above, the BET switches 4 are switches for inputting a wager in each game. As well known, if one credit (or unit of bet) is 5 cents, for example, the player can select 5 cents/line by pushing 1BET switch, and 10 cents/line by pressing 2BET switch, and so on. The line-selecting switches 5 are switches that can be used for determining how many pay lines should be selected in each slot game, as mentioned above. However, the switches 5 may also be used to select a card, which the player wants to discard, in the case where the gaming machine 1 provides a card game (in the porker game, for example, 10LINE switch may be used to indicate the left-end card to be discarded, 20LINE switch may be used to indicate the card on the right of the left-end card, and so on.). The number of BET switches 4 and line-selecting switches 5 may not be limited to five, but may be any arbitrary number. The gaming machine 1 may additionally have a switch for casting a bet as an extra bet. The "extra bet" used in this specification means a bet paid by the player in addition to the bet paid for playing the primary game. For example, the extra bet may be paid to have the player (or the gaming machine at which the player is playing) eligible for the progressive game.

The MAXBET switch 6 is a switch for inputting the maximum bet that the player can spend at a time in a single game. The PAYOUT switch 7 is a switch to be operated by the player when the player wants to quit the game and collect the amount of money which has been credited onto the gaming machine 1. The coin slot 8 is a hole for receiving coins as credit for playing the games. The bill acceptor 9 is a hole used to accept a bill or a cash card as credit for playing the games, or to payout the amount of money, which has been credited in the gaming machine 1, to the player. The coin payout mouth 10 is a tray to pay out a player the amount of money which has been credited in the gaming machine 1.

The gaming machine 1 related to the present invention is not limited to the above, but it may have other various functions, and/or some of the above-mentioned functions may be omitted. For example, the gaming machine 1 may have a lighting apparatus for providing illumination in a color or a plurality of colors when the player proceeds to the secondary game, for example. The gaming machine 1 may also have an apparatus for outputting music or any other sound and/or an apparatus for vibrating the whole gaming machine, when the player proceeds to the secondary game, for example. The gaming machine 1 may have three or more displays or only a single display. The gaming machine 1 may have a REPEAT switch for choosing the bet per line and number of activated pay lines that the player selected in the last game again.

Reels, roulette, etc., which are used in the game, may not necessarily be displayed on the display 2. A stepper (mechanical reels), mechanical roulette, etc. may be mounted in the gaming machine 1 instead of or in addition to images of the reels, roulette, etc. There may be a display etc. which is used in a plurality of gaming machines in common.

Figure 2:
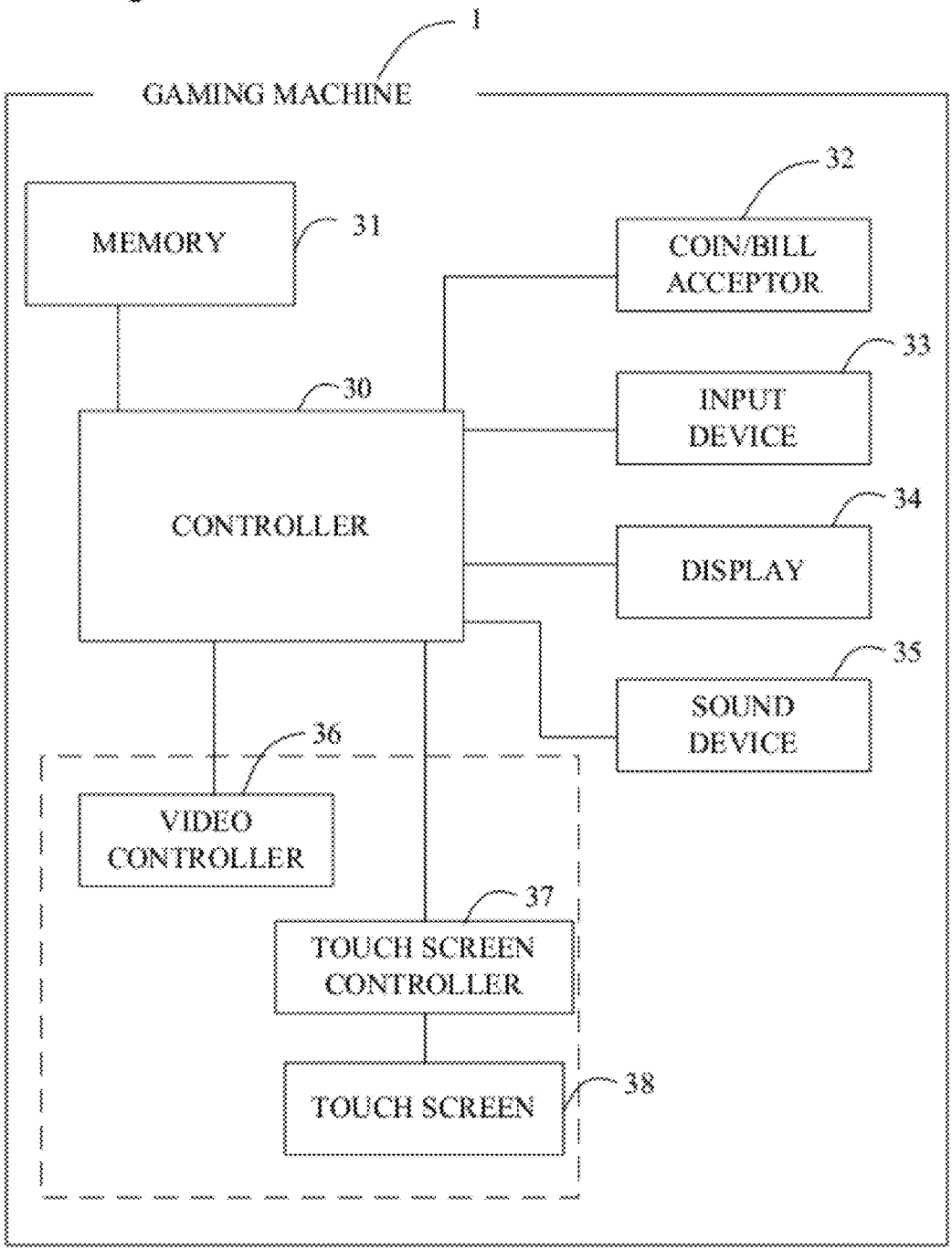
FIG. 2 is a block diagram illustrating an example of a gaming machine of the present invention.

FIG. 2 is a block diagram illustrating an example of an operational structure of the gaming machine 1 of the present invention. The gaming machine 1 is configured with a controller 30, a memory 31, a coin/bill acceptor 32, an input device 33, a display 34, a sound device 35, a video controller 36, a touch screen controller 37 and a touch screen 38. The controller 30 executes a game program for conducting the primary game and the secondary game. The memory 31 stores information regarding a game status, a game program and data, etc. The coin/bill acceptor 32 equipped as the coin slot 8 and the bill acceptor 9 of FIG. 1 receives a coin or a bill from a player. The input device 33, which is equipped as the BET switches 4, the selection switches 5, the MAXBET switch 6, the PAYOUT switch 7 and the spin button 11 of FIG. 1, serves to receive an operation from the player and transmits the operation to the controller 30. The display 34 (corresponding to the displays 2 in FIG. 1) indicates information regarding the game. The sound device 35 can be used to make a sound to excite or entertain the player. The video controller 36 may be used to process a game image to be displayed on the display 34. The touch screen controller 37 controls the touch screen 38, which can be disposed over one or both of the displays 2 in FIG. 1 to receive an operation from the player. The controller 30 is connected to the memory 31, the coin/bill acceptor 32, the input device 33, the display 34, the sound device 35, the video controller 36 and the touch screen controller 37 to process information received from these component parts and control them to carry out the game provided by the gaming machine 1.

Figure 3:
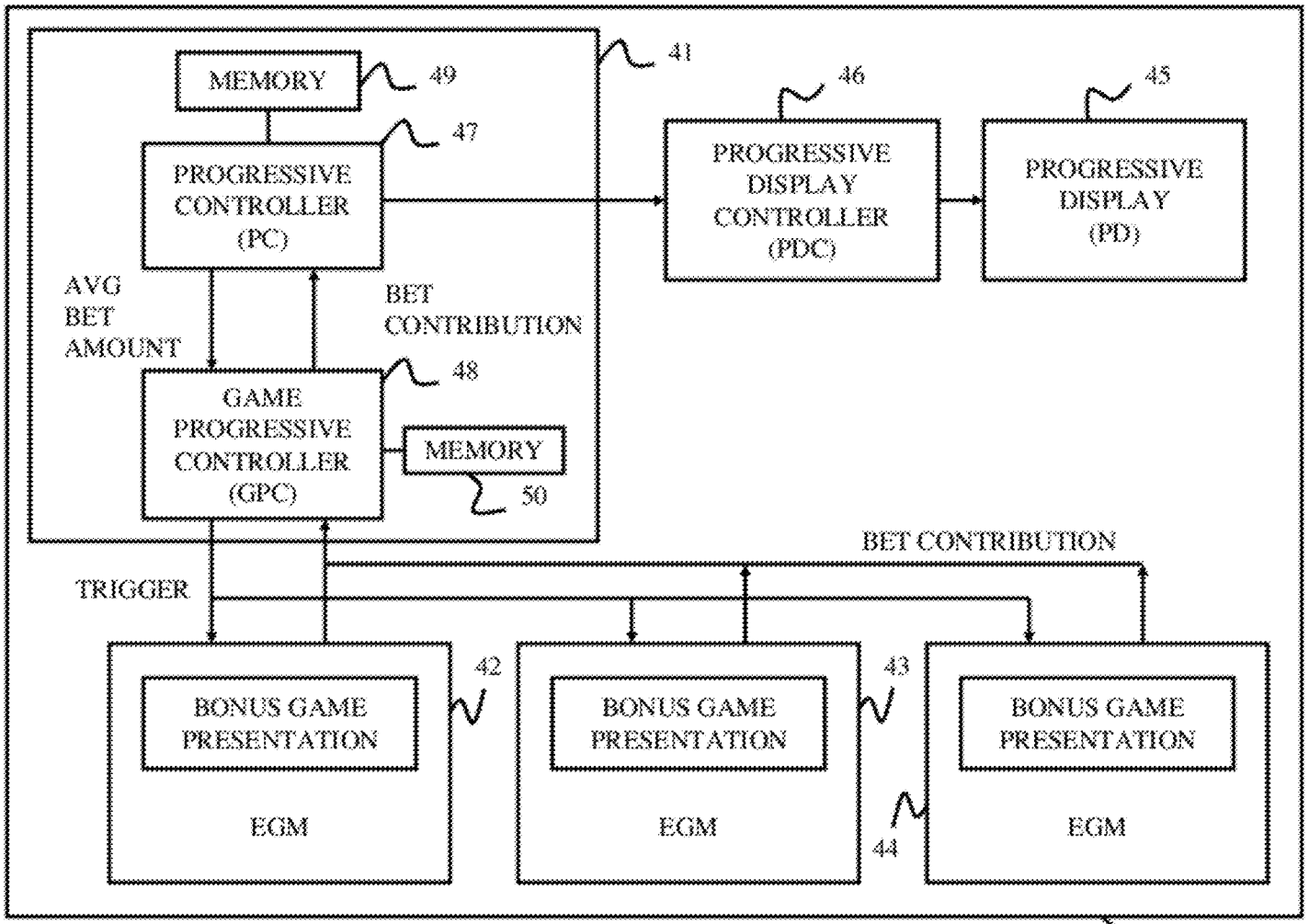
FIG. 3 is a block diagram illustrating an example of a gaming system of the present invention.
Figure 4D:
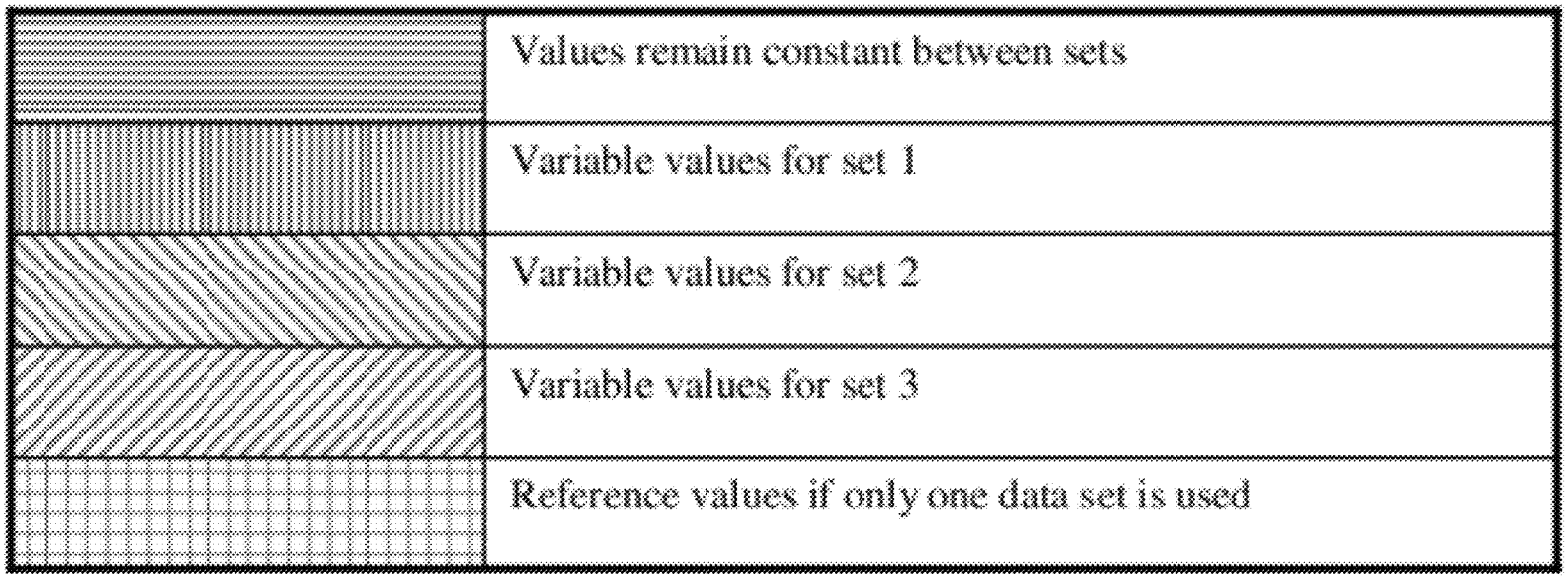
Figure 5D:
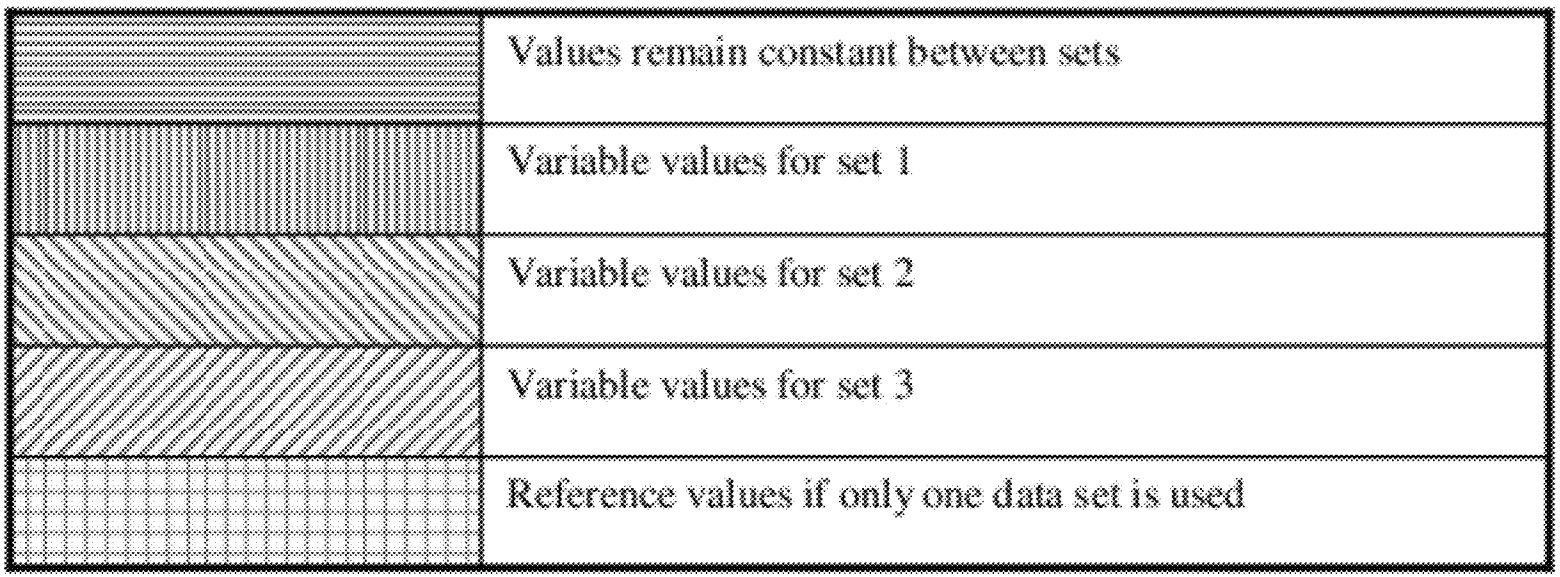
Figure 6D:
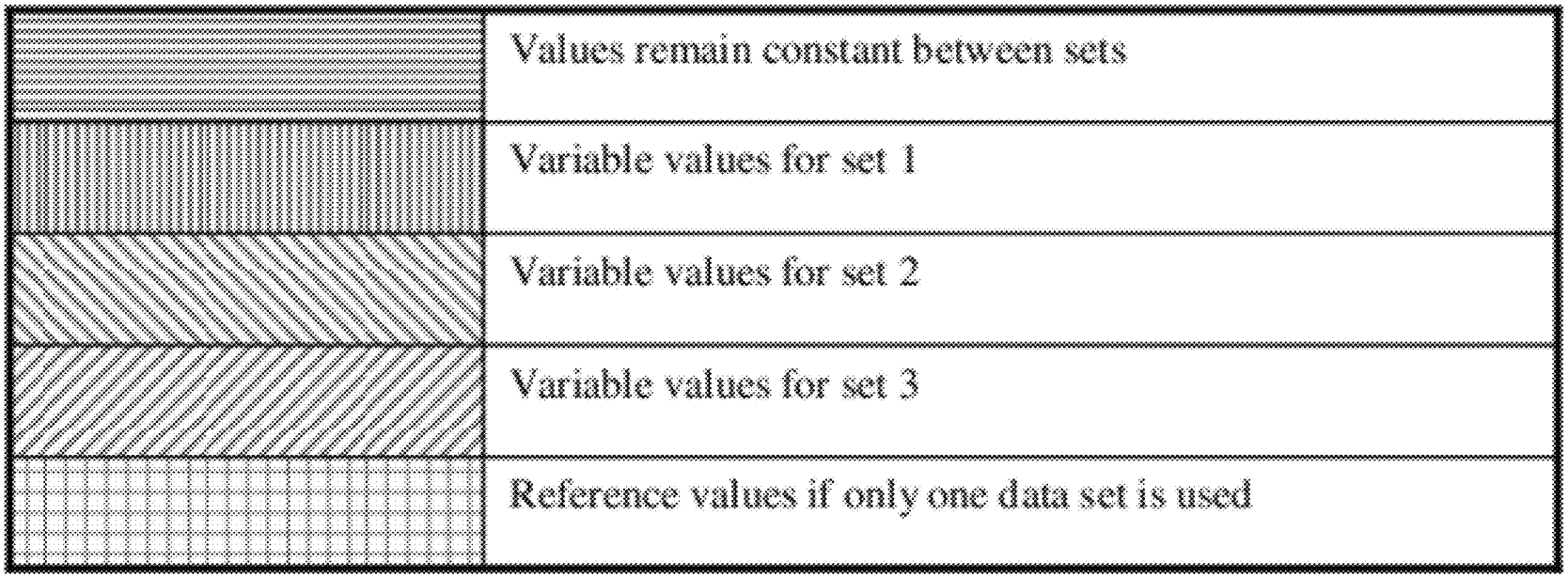

FIG. 3 is a block diagram illustrating an example of a gaming system according to an embodiment of the present invention. The gaming system 40 has a progressive control section 41, a plurality of electronic gaming machines (EGMs) 42, 43, 44, a progressive display (PD) 45, and a progressive display controller (PDC) 46. Each EGM 42, 43, 44 may consist of a video slot machine described above with reference to FIGS. 1 and 2, for example. The progressive display 45 is connected to the progressive control section 41 via the progressive display controller 46 to display information regarding the progressive game.

The progressive control section 41 comprises a progressive controller (PC) 47 and a game progressive controller (GPC) 48 which are in communication to each other. The PC 47 and GPC 48 have respective memories 49, 50 connected to them for storing programs and data necessary for the PC 47 and GPC 48 to function properly. The EGMs 42, 43 and 44 are connected to the GPC 48 of the progressive control section 41 by any suitable means such as via local area network (LAN), and each EGM 42, 43, 44 is adapted to send a "bet contribution" to the GPC 48 every time the player places a bet in the EGM during the primary game. It should be noted here that the "bet contribution" is a portion of the player's bet that is to be dedicated to the progressive game. In this sense, the extra bet for having the EGM eligible for the progressive game is considered a bet contribution.

In the present embodiment, four different progressive levels are defined as the progressive award in the progressive game. Names of the progressive levels are, for example, "MAXI," "MEGA," "MAJOR," and "MINI." These progressive levels have different reset values (or starting values) from each other, for example, $1,000, $500, $100, and $10, respectively, so that they have different average payout (or jackpot) values.

The bet contribution received from each EGM 42, 43, 44 is transmitted from the GPC 48 to the PC 47, which accumulates a part of the bet contribution on the four progressive levels. In this way, the amount of each of the four progressive levels is increased gradually during the primary game. The amount of each of the progressive levels is preferably displayed on the progressive display 45 to enhance the expectation of the players for winning higher awards.

In the present embodiment, the GPC 48 determines whether a predetermined condition is met for triggering (or starting) the progressive game, and when the progressive game is triggered, the GPC 48 selects one of the progressive levels to be paid out to the player according to predetermined hit frequencies (or hit cycles) assigned to respective progressive levels, as described in detail below.

Typically, the amount of a progressive level shown on the display when the progressive level is selected by the GPC 48 in the progressive game is paid out to the player. It should be noted, however, that the progressive game may contain a fixed value award in addition to the progressive awards.

According to the present invention, the gaming system 40 has two or more data sets for determining the odds (or frequency) of triggering the progressive game. Specifically, in the illustrated preferred embodiment, there are provided three data sets Set 1, Set 2, Set 3, as shown in FIGS. 4A-4D. The three data sets have different values of Trigger amount, which is an assumed or target average bet amount (or investment from the players) between two progressive hits or triggers. Specifically, Set 1 has Trigger amount of $50, Set 2 $200, and Set 3 $800 in the example of FIG. 4B. Each of the data sets forth values of various parameters for each of the four progressive levels MAXI, MEGA, MAJOR and MINI based on the respective values of Trigger amount such that a predetermined payout percentage (PAYOUT %), which in this example 80%, is achieved. The parameters comprise, for example, "RESET", "INCREMENT % (INC. %)", "CYCLE", "Weight", "RESET %", "Distribution (Distrib %)" and "Average progressive award (Av. Jackpot)".

"RESET" is a starting value or reset value of each progressive level, and when a certain progressive level is hit, the amount of progressive level is reset to the value set as "RESET". As shown in FIGS. 4A-4D, in one embodiment the three data sets set forth the same value of "RESET" for each progressive level.

"INC. %" (increment rate) indicates a percentage of a portion of a bet that is accumulated on each progressive level with respect to the bet placed by the player, and in the embodiment of FIG. 4, has the same value (10%) for all of the four progressive levels in all of the three data sets Set 1-3.

"CYCLE" indicates the odds for hitting each progressive level. For example, the value 294.00 for the progressive level MAXI in Set 1 means that the progressive level MAXI is hit, in average, once in 294 times when the progressive game is triggered. It should be noted that the values of "CYCLE" for the progressive levels can vary from one data set to another in accordance with the respective "Trigger amount."

"Weight" shows the relationship between the values of "CYCLE" for different progressive levels by using "integers" and thus is essentially equivalent with "CYCLE".

"RESET %" indicates a percentage of a portion of a bet used for establishing the reset value "RESET" for each progressive level with respect to the bet placed by the player, and can be calculated from "Trigger amount," "RESET," and "CYCLE," as follows: RESET %=RESET/CYCLE/Trigger amount*100

"Distrib %" is a percentage expression of an inverse of "CYCLE" and thus is essentially equivalent to "CYCLE."

"Av. Jackpot" is an average amount of each progressive level paid out to the player when the progressive level is hit, and can be calculated from the "Trigger amount," "RESET," "INC. %," and "CYCLE," as follows: Av. Jackpot=RESET+Trigger amount*INC. %/100*CYCLE In one embodiment, "RESET" and "INC. %" are preferably stored in the memory 49 connected to the PC 47, while "Distrib %" is preferably stored in the memory 50 connected to the GPC 48. "CYCLE" and "Weight" may be also stored in the memory 50 but this is not indispensable because, as mentioned above, "CYCLE" and "Weight" are essentially equivalent to "Distrib %". Also, "Trigger amount" of each data set is stored in the memory 50. It should be noted that instead of separate memories 49 and 50, it is possible to use a common memory that can be accessed by both of the PC 47 and GPC 48 and store all of the information contained in the data sets in the common memory.

Referring back to FIG. 3, based on the bet contributions transmitted from the EGMs 42, 43, 44 via the GPC 48, the PC 47 calculates an average bet amount for the entire system, which is a sum of the bet contributions from the EGMs 42, 43, 44 per certain unit. As will be described in detail below, there can be various ways for calculating the average bet amount, but in one embodiment, the average bet amount can be calculated as a sum of the bet contributions per certain time period, e.g., per hour, by accumulating the bet contributions from the EGMs 42, 43, 44 during a predetermined time period and then dividing the accumulated bet contributions with the predetermined time period. Therefore, in general, the average bet amount tends to increase as the number of players playing at linked EGMs increases, as the amount of bet contribution placed by each player per spin increases, and as the frequency of game play of each player increases. It should be noted that the average bet amount is calculated or updated at a predetermined time interval, such as every 10 minutes, or in response to certain events, such as every time a bet contribution is transmitted from any of the EGMs 42, 43, 44, though the updating or calculation timing of the average bet amount may not be limited thereto.

The calculated average bet amount is transmitted from the PC 47 to the GPC 48, and the GPC 48 uses the average bet amount to select one of the data sets. In the embodiment of FIG. 4B, a selection table is provided to define a minimum cutoff average bet per hour and a maximum cutoff average bet per hour for each of the data sets Set 1-3, and the selection table is stored in the memory 50 connected to the GPC 48. Specifically, in FIG. 4B, the minimum cutoff bet per hour and the maximum cutoff bet per hour for data set Set 1 are $0.00 and $599.99, respectively, for data set Set 2, $600.00 and $2,399.99, respectively, and for data set Set 3, $2,400.00 and $99,999.99, respectively. Thus, when the calculated average bet amount is below $600.00, the data set Set 1 having a low Trigger amount of $50 is selected, when the calculated average bet amount falls in the range from $600.00 to $2,399.99, the data set Set 2 having a middle Trigger amount of $200 is selected, and when the calculated average bet amount is equal to or larger than $2,400.00, the data set Set 3 having a high Trigger amount of $800 is selected. Thus, according to the present invention, a data set having a lower Trigger amount is selected for a lower average bet amount and a data set having a higher Trigger amount is selected for a higher average bet amount.

After selecting one of the data sets, the GPC 48 uses the Trigger amount corresponding to the selected data set to determine whether the progressive game is triggered or not for each bet contribution transmitted from the EGMs 42, 43, 44. Specifically, in one embodiment, the progressive game is triggered (or the progressive game hits) when the following relationship or formula is satisfied: A>B*R . . . (1), where A is a bet contribution from any of the EGMs 42, 43, 44, B is the Trigger amount of the selected data set, and R is a random number between 0 and 0.999999999. Thus, in general, the higher the bet contribution is, the higher the chance of hitting the progressive game is.

It should be noted that the gaming system 40 must be designed such that the players cannot place a single bet contribution equal to or larger than the selected Trigger amount, because if the bet contribution (A) were equal to or larger than the Trigger amount, the above relationship for determining the hit of progressive game would always hold irrespective of the value of R, i.e., such a bet contribution would always trigger the progressive game.

By adopting the above way of determining whether the progressive game is triggered, it is possible to trigger the progressive game, in average, once for every accumulation of bet contributions from the EGMs becoming equal to the selected Trigger amount. In other words, an actual investment from the EGMs between two progressive hits can be equal to the selected Trigger amount, in average. Accordingly, when the hit frequency is expressed as "once per certain time period," such as "once per X minutes," for example, the certain time period ("X") can be substantially equal to a value obtained by dividing the selected Trigger amount with the calculated average bet amount (with appropriate time unit adjustment, if necessary).

This is illustrated in the upper three tables in the example of FIG. 4A. Specifically, the uppermost table shows the value of "X" of hit frequency in minutes for various values of average bet amount per hour less than $599.99, resulting in the selection of data set Set 1 or Trigger amount of $50.00. Similarly, the second uppermost table shows the hit frequency in minutes for various values of average bet amount per hour that result in the selection of data set Set 2 according to the selection table, and the third uppermost table shows the hit frequency in minutes for various values of average bet amount per hour that result in the selection of data set Set 3. It will be understood that for the average bet amount of $15.00 per hour (the leftmost column in the uppermost table), for example, the corresponding value of "X" of hit frequency in minutes of 200.0 is calculated by 50/15*60, where 50 is the Trigger amount of data set Set 1, 15 is the average bet amount and 60 is a coefficient converting the time unit from "hour" to "minutes", and the similar way of calculation can apply to the other values of the average bet amount in these tables.

The bottom row of each of the three tables of FIG. 4A show the value of "X" of hit frequency in minutes if only one data set, e.g., data set Set 2 (and hence the corresponding Trigger amount of $200.00), were used for every average bet amount. It will be noted that in the uppermost table, the value of "X" of hit frequency is four times larger when the data set Set 2 is used than when the data set Set 1 is used because the Trigger amount of data set Set 2 ($200.00) is four times larger than that of data set Set 1 ($50.00). As a result, when the data set Set 2 is used, for the very low average bet amount per hour, such as $15.00 and $30.00, the hit frequency in minutes becomes once in 800.0 minutes and once in 400.0 minutes, respectively, which would be impractically low. In contrast, when the data set Set 1 is used, the value of "X" of hit frequency is limited to 200.0. Similarly, in the third uppermost table, the value of "X" of hit frequency is reduced to one forth when the data set Set 2 is used than when the data set Set 3 is used because the Trigger amount of data set Set 2 ($200.00) is one forth of that of data set Set 3 ($800.00). As a result, for the very high average bet amount per hour, such as $15,000.00 and $30,000.00, the hit frequency in minutes is once in 0.8 minutes and once in 0.4 minutes, respectively, which would be impractically too high. This is avoided when the data set 3 is used for such high average bet amount.

It should be understood that in the present invention, the number of data sets may not be limited to three and one or more data sets having a lower or higher Trigger amount, e.g., $12.5 or $3200.0, may be added, if necessary, to keep the hit frequency within a narrower range. There is no fixed upper limit to the number of data sets though a practical number of data sets would be from three to five.

When it is determined that the progressive game is triggered for a certain bet contribution, the GPC 48 determines the EGM or player who has inputted the bet contribution. Also, the GPC 48 determines which of the four progressive levels "MAXI," "MEGA," "MAJOR," and "MINI" is won in accordance with the chance of winning for each progressive level defined as "Distrib %" in the selected data set (or odds table) and pay out the won progressive level to the player or EGM 42, 43, 44 and the won progressive level is reset to its reset value ("RESET"). As mentioned above, the parameters such as "Distrib %" in each data set Set 1-3 are designed such that the same prescribed payout percentage, e.g., 80.00%, is achieved, and therefore, irrespective of which data set is used, it is ensured that the predetermined payout percentage is maintained.

The GPC 48 also sends the information indicating that the progressive game is triggered, which of the four progressive levels is won, and who (or which EGM) wins the progressive level, to each EGM 42, 43, 44, and the EGMs 42, 43, 44 provide an appropriate bonus game presentation to the players by using illuminations, sounds, moving pictures or animations on the display and/or any other suitable means, to enhance the excitement of the players, before the progressive award winner is announced to the players. The information is preferably sent to the PC 47 as well so that an appropriate bonus game presentation can be provided on the progressive display (PD) 45 and/or other appropriate devices, such as loud speakers or lighting units (not shown in the drawings), controlled by the PC 47.

Thus, according to the above preferred embodiment of the invention, the gaming system 40 has a plurality, e.g., three, data sets having different values of Trigger amount, and one of the data sets is selected depending on the average bet amount such that a data set having a lower Trigger amount is selected for a lower average bet amount and a data set having a higher Trigger amount is selected for a higher average bet amount. The Trigger amount corresponding to the selected data set is used in determining whether the progressive game is triggered for each bet contribution from the EGMs contained in the gaming system. Therefore, in the present invention, it is possible to select an appropriate value of Trigger amount for the varying average bet amount and determine whether the progressive game is triggered by using the selected Trigger amount, to thereby keep the hit frequency of the progressive game within a desired range for a wide range of average bet amount.

Also, each of the plurality of data set sets forth parameters for determining the amount of each progressive level and the chance for winning each progressive level in such a way that a same prescribed payout percentage is achieved for the corresponding Trigger amount. In this way, it is ensured that the prescribed payout percentage is always achieved irrespective of which data set is used.

It should be noted that the parameters of each data set for achieving the prescribed payout percentage are not limited to the example shown in FIGS. 4A-4D. FIGS. 5A-5D show another example of data sets (Set 1, Set 2, Set 3) that can achieve the same payout percentage (80.0000%) for the same values of Trigger amount ($50, $200, $800). In the example of FIGS. 5A-5D, in each of the data sets, the reset values ("RESET") of "MAXI," "MEGA," and "MAJOR" are higher, i.e., $10,000.00, $1,000.00 and $100.00, respectively, than those of FIG. 4, i.e., $1,000.00, $200.00 and $50.00, respectively, while the reset value of "MINI" is the same, i.e., $10.00. Also, in the example of FIG. 5, the values of "INC. %" vary for the different progressive levels, i.e., 2.0000%, 4.0000%, 6.0000% and 8.0000% for "MAXI," "MEGA," "MAJOR" and "MINI," respectively, while the values of "INC. %" is constant (10.0000%) in the example of FIG. 4. "CYCLE," "Weight," and "Distrib %", which are equivalent to each other, are determined such that the prescribed payout percentage is achieved for the above "RESET" and "INC. %" of each progressive level. "RESET %" and "Av. Jackpot" can be calculated from the other parameters, as described above. Thus, the parameters of each data set can be arbitrarily designed by the game designer for a given Trigger amount and payout percentage, and the present invention should not be limited to the illustrated examples.

Also, the calculation of the average bet amount can be carried out in a variety of ways. In one embodiment, the average bet amount per time period, e.g., per hour, can be determined in the following ways:

1) Each time the secondary game (or progressive game) is triggered, the average bet amount per time period is determined by calculating the total of the bet contributions from the EGMs between this secondary game trigger and the previous secondary game trigger, and dividing this by the time between the two secondary game triggers.

2) Each time the secondary game is triggered, the average bet amount per time period is determined by calculating the total of the bet contributions from the EGMs that were made in a predetermined time period prior to the secondary game trigger, e.g., total bet in the last five minutes.

3) For a predetermined time period the average bet amount per time period is determined by using the total of the bet contributions from the EGMs in this time period. A new time period starts as soon as the old period is expired.

4) Each bet contribution from the EGMs is registered with a time stamp. An average bet amount per time period is determined each time a new bet contribution is made by using the last n number of bet contributions, where n is an integer larger than one. In other words, the average bet amount per time period can be calculated by obtaining the time interval between the first and last of the last n number of bet contributions, calculating the sum of the last n number of bet contributions, and dividing the sum with the time interval.

5) Each bet contribution from the EGMs is registered with a time stamp. An average bet amount per time period is determined each time a new bet contribution is made by using the total of the bet contributions that were made within a predetermined time period.

Further, in the above embodiment, the average bet amount was calculated as a sum of bet contributions per time period (such as "per hour") but the present invention may not be limited thereto. The average bet amount can be calculated as a sum of bet contributions "per spin" instead of "per hour." For example, if the system comprises fifty EGMs and the fifty EGMs have the same average bet contribution per spin (or per game), e.g., $0.10, then the average bet amount per spin for the system is $0.10*50=$5.00. FIGS. 6A-6D show an embodiment in that the average bet amount is represented as a bet amount per spin. It should be noted that in the example of FIGS. 6A-6D also, the same data sets can be used as in the example of FIGS. 4A-4D. However, the selection table for selecting one of the data sets has different minimum and maximum cutoff bets adapted for the average bet amount per spin. Also, the hit frequency is represented "once per Y spins" in the example of FIGS. 6A-6D, and the upper two tables show values of "Y" for various values of average bet amount per spin. It should be noted, however, that in this case also, the value "Y" can be calculated by dividing the value of Trigger amount with the value of average bet amount.

Still further, though in the above embodiments, the bonus game or secondary game was embodied as a progressive game, the secondary game may not have to be a progressive game but may have fixed different award levels. In other words, the parameter "INC. %" in at least one of the data sets may be zero. Also, the number of different award levels may not have to be four as in the above embodiment, but may be at least two and there is no fixed upper limit, although a practical number of different award levels (progressive levels) to be awarded would be three or four.

Figure 7:
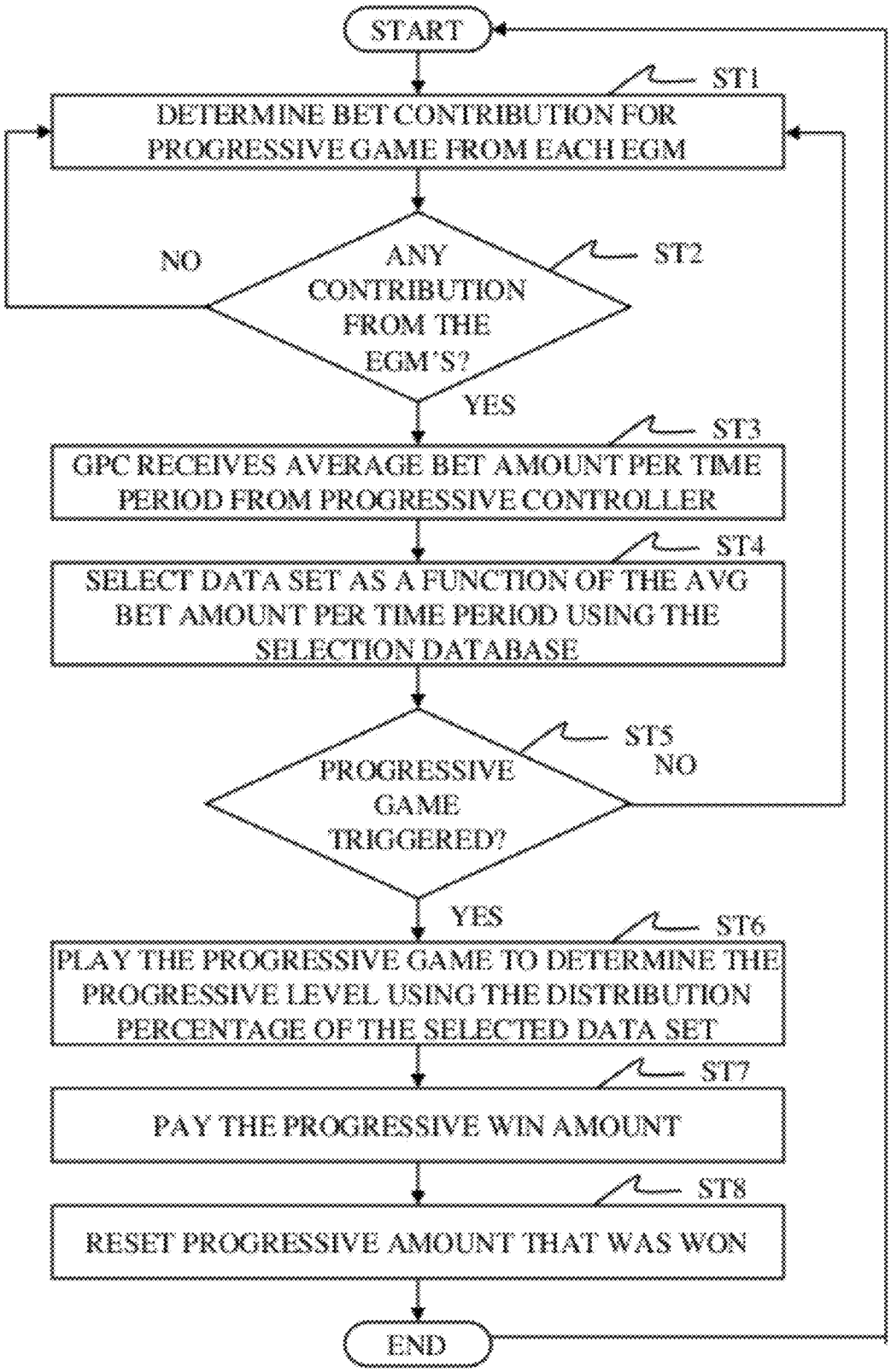
FIG. 7 is a flowchart illustrating an operation of the gaming progressive controller of the gaming system shown in FIG. 3.

FIG. 7 is a flowchart showing the operation of the GPC 48 in FIG. 3. In step ST1, the GPC determines a bet contribution from each of the EGMs 42, 43, 44. The determined bet contributions from the EGMs 42, 43, 44 are transmitted to the PC 47, which calculates an average bet amount per time period, as described above.

In step ST2, it is determined whether or not there is any bet contribution from the EGMs 42, 43, 44. If there is no bet contribution, the process goes back to step ST1, while there is any bet contribution, the process proceeds to step ST3.

In step ST3, the GPC 48 receives the average bet amount per time period from the PC 47, and then the process proceeds to step ST4.

In step ST4, the GPC 48 selects one of the data sets or odd tables Sets 1-3 depending on the average bet amount per time period using the selection table, as described above with reference to FIG. 4.

Then, in step ST5, the GPC 48 determines if the progressive game is hit for each bet contribution (or actual contribution) from the EGMs 42, 43, 44 as a function of the Trigger amount from the selected data set and a random number generated by a random number generator, which can be embodied as a part of the GPC 48, for example (see above). If it is determined that the progressive game is triggered in step ST5, the process proceeds to step ST6 and if not, the process goes back to step ST1.

In step ST6, the GPC 48 determines which of the plurality of progressive levels is won by using the distribution percentage ("DISTRIB %") of the selected data set. As described above, the information regarding the progressive hit is transmitted to the EGMs 42, 43, 44 and the PC 47, which conduct an appropriate progressive game presentation.

Thereafter, in step ST7, the GPC 47 pays out the progressive win amount, i.e., the amount of the won progressive level at the time of the triggering of the progressive game, which is transmitted from the PC to the GPC 47, to the EGM 42, 43, 44 that triggered the progressive game.

In step ST8, the PC 47 resets the amount of the won progressive level that was won, and the process goes back to step ST1.

Figure 8:
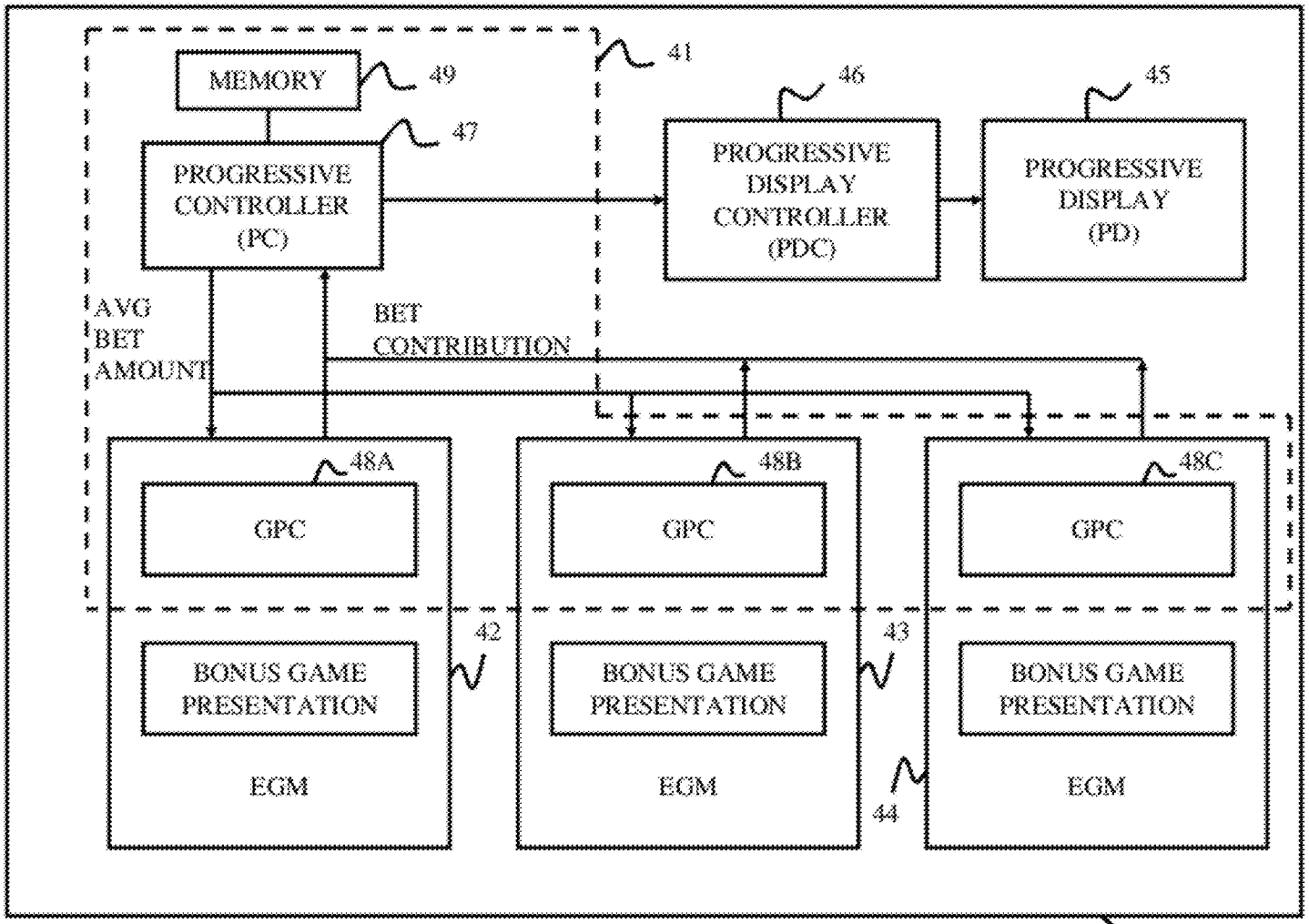
FIG. 8 is a block diagram showing another embodiment of the gaming system according to the present invention.

In the embodiment of the gaming system 40 shown in FIG. 3, a single GPC 48 was provided and connected to the EGMs 42, 43, 44 but the present invention may not be limited to such an embodiment. FIG. 8 shows an alternative embodiment of the gaming system. In FIG. 8, component parts similar to those of FIG. 3 are denoted with the same reference numerals and a detailed explanation thereof is omitted.

In the gaming system 40A of FIG. 8, the EGMs 42, 43, 44 are provided with respective GPCs 48A-48C. Thus, in this embodiment, the PC and the GPCs 48A-48C constitute the progressive control section 41. Each of the GPCs 48A-48C transmits the bet contribution placed by the player to the PC 47, the PC 47 sends back to the GPCs 48A-48C the average bet amount for the entire system. Then, each of the GPCs 48A-48C selects one of the data sets in accordance with the average bet amount. Subsequently, each GPC 48A-48C determines whether the progressive game is triggered for each bet contribution input by the player to the associated EGM based on the formula (1) using the Trigger amount of the selected data set and a random number. If it is determined in one of the GPCs 48*a*-48*c* that the progressive game is triggered, the GPC determines which of the progressive levels is won and transmits the information regarding the triggering of the progressive game to the PC 47 as well as to the other EGMs such that an appropriate progressive game presentation can be provided by the PC 47 and the EGMs.

Thus, in the embodiment of FIG. 8 also, an appropriate Trigger amount can be selected depending on the average bet amount whereby the progressive game hit frequency can be maintained within a desired range for a wide range of average bet amount.

Figure 9:
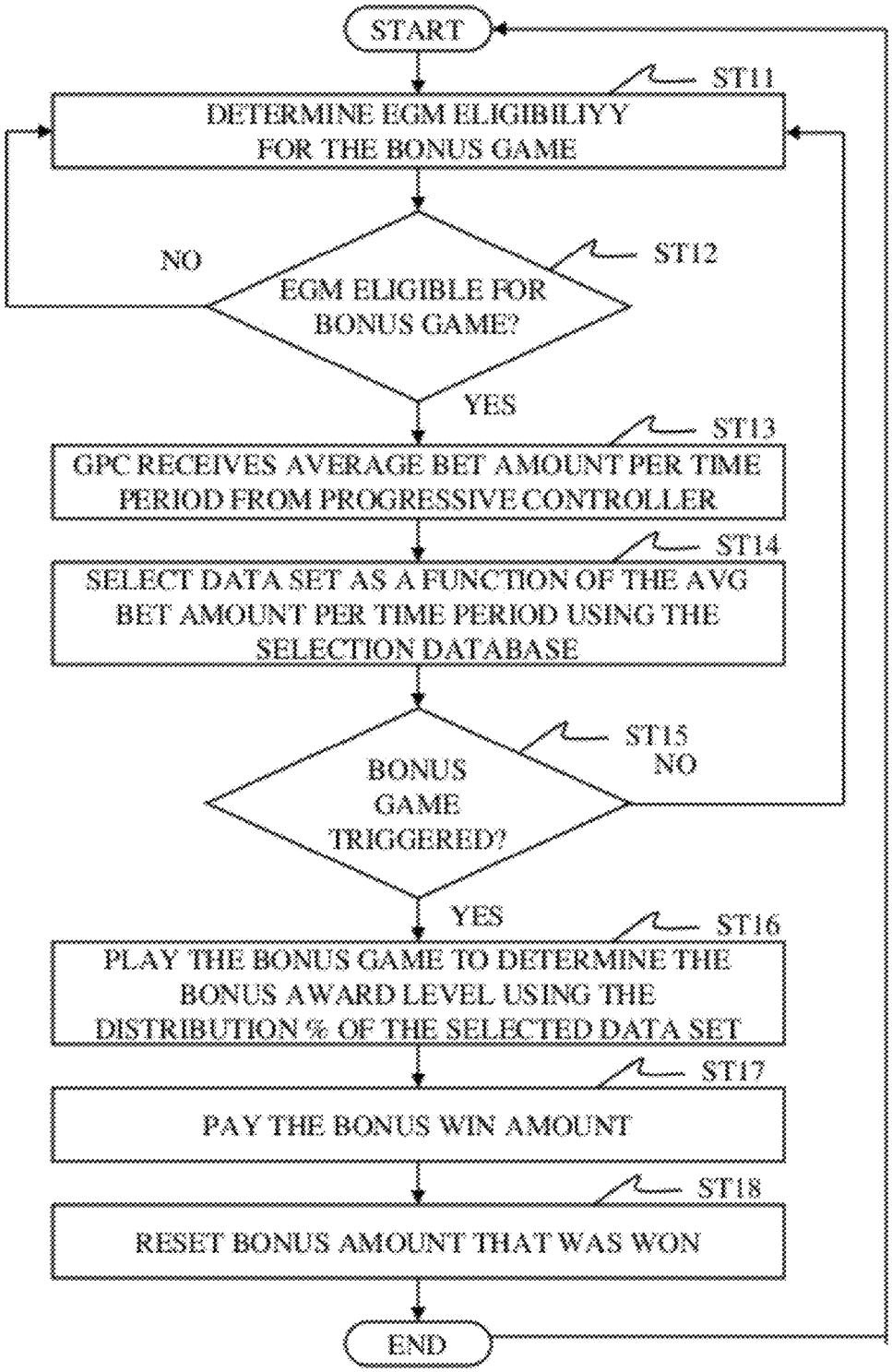
FIG. 9 is a flowchart illustrating an operation of one of the gaming progressive controllers of the gaming system shown in FIG. 8.

FIG. 9 is a flowchart showing the operation of GPC 48A provided to the associated EGM 42. It should be understood that the other GPCs 48B, 48C operate in a similar way.

In step ST11, the GPC 48A determines eligibility of the associated EGM 42 for the progressive game or bonus game. One way for determining the eligibility is determining an amount of bet contribution input to the EGM 42 by the player. The determined amount of bet contribution is transmitted to the PC 47 so that the PC 47 can calculate the average bet amount for the entire system.

In step ST12, it is determined whether or not the EGM 42 is eligible for the progressive game depending on the amount of bet contribution determined in step ST11. For example, if the amount of bet contribution is higher than a predetermined value, it is determined that the EGM 42 is eligible for the progressive game. If it is determined that the EGM 42 is eligible for the progressive game, the process proceeds to step ST13 and if not, goes back to step ST11.

In step ST13, the GPC 48A receives the average bet amount per time period from the PC 47, and then the process proceeds to step ST14.

In step ST14, the GPC 48A selects one of the data sets or odds tables Sets 1-3 depending on the average bet amount per time period using the selection table, as described above with reference to FIGS. 4A-4D.

Then, in step ST15, the GPC 48A calculates if the progressive game is hit for the bet contributions (or actual contributions) from the EGM 42 using the Trigger amount from the selected data set and a random number generated by a random number generator, which can be embodied as a part of the GPC 48A, for example. If it is determined that the progressive game is triggered in step ST15, the process proceeds to step ST16 and if not, the process goes back to step ST11.

In step ST16, the GPC 48A determines which of the plurality of progressive levels is won by using the distribution percentage ("DISTRIB %") of the selected data set. As described above, the information regarding the progressive hit is transmitted to the other EGMs 43, 44 and the PC 47, which conduct an appropriate progressive game presentation.

Thereafter, in step ST17, the GPC 48A pays out the progressive win amount, i.e., the amount of the won progressive level at the time of the triggering of the progressive game, to the associated EGM 42.

In step ST18, the PC 47 resets the amount of the won progressive level that was won, and the process goes back to step ST11.

In the above description, the present invention was explained with respect to its preferred embodiments. It should be noted, however, the embodiments were provided for illustrative purposes and the present invention should not be limited to these embodiments. A person having ordinary skill in the art can modify or alter the preferred embodiments without departing the scope of the present invention, which is defined by the following claims.

For example, the number of EGMs may not be limited to three but of any number. The number of EGMs may be one, i.e., the present invention may be applied to a single EGM. In such a case, the controller 30 in FIG. 2 may serve the progressive control section 41 containing the PC 47 and GPC 48 shown in FIG. 3.

What is claimed is:

1. A gaming system, comprising:

a plurality of gaming machines each conducting a primary game; and a secondary game control section connected to the gaming machines for conducting a secondary game, the secondary game control section being provided with a plurality of data sets having different target investment amount between two triggerings of the secondary game, the secondary game control section being adapted to receive data related to a wager from each of the plurality of gaming machines and to calculate an average bet amount as a function thereof, where the secondary game control section selects one of the data sets as a function of the calculated average bet amount, and the secondary game control section determines whether the target investment amount associated with the selected one of the data sets has been met as a function of the average bet amount responsively detects a trigger condition of the secondary game if the target investment amount has been met, and pays out a secondary game award to one of the gaming machines in response to detection of the trigger condition.

2. The gaming system according to claim 1, wherein the secondary game has a plurality of award levels, the plurality of data sets define odds of winning the plurality of award levels based on the respective target investment amounts and a predetermined payout percentage, and the secondary game control section determines which of the plurality of award levels is won according to the odds defined by the selected one of the data sets when the secondary game is triggered.

3. The gaming system according to claim 2, wherein the secondary game is a progressive game and the plurality of award levels comprise at least one progressive level, and the plurality of data sets comprise parameters for defining an increment rate and reset value of the at least one progressive level according to which the secondary game control section calculates an amount of the at least one progressive level based on the bet contributions from the gaming machines.

4. The gaming system according to claim 1, wherein the secondary game control section comprises:

a first controller for calculating the average bet amount; and a second controller for selecting one of the data sets depending on the average bet amount and determining whether the secondary game is triggered using the target investment amount associated with the selected one of the data set.

5. The gaming system according to claim 4, wherein the second controller has a plurality of controllers provided to respective gaming machines.

6. The gaming system according to claim 1, wherein the average bet amount consists of an average bet amount per time period.

7. The gaming system according to claim 6, wherein each time the secondary game is triggered, the average bet amount per time period is determined by calculating a total of the bet contributions from the gaming machines between the secondary game trigger and a previous secondary game trigger, and dividing the total by a time between the two secondary game triggers.

8. The gaming system according to claim 6, wherein each time the secondary game is triggered, the average bet amount per time period is determined by calculating a total of the bet contributions from the gaming machines that were made in a predetermined time period prior to the secondary game trigger.

9. The gaming system according to claim 6, wherein the average bet amount per time period is determined for a predetermined time period by using a total of the bet contributions from the gaming machines in this time period, and a new time period starts as soon as the old period is expired.

10. The gaming system according to claim 6, wherein each bet contribution from the gaming machines is registered with a time stamp, and the average bet amount per time period is determined each time a new bet contribution is made by using the last n number of bet contributions, where n is an integer larger than one.

11. The gaming system according to claim 6, wherein each bet contribution from the gaming machines is registered with a time stamp, and the average bet amount per time period is determined each time a new bet contribution is made by using a total of the bet contributions that were made within a predetermined time period.

12. A gaming machine, comprising:

a game control section for conducting a primary game and a secondary game; and, a plurality of data sets associated with the game control section each having a different target investment amount, the game control section being adapted to calculate an average bet amount from bet contributions input by a player, where the game control section selects one of the data sets depending on the calculated average bet amount, and the game control section determines whether the secondary game is triggered once the target investment amount associated with the selected data set has been met, and if the secondary game is triggered, pays out a secondary game award to the player.

13. The gaming machine according to claim 12, wherein the secondary game has a plurality of award levels, the plurality of data sets define odds of winning the plurality of award levels based on the respective target investment amounts and a predetermined payout percentage, and the game control section determines which of the plurality of award levels is won according to the odds defined by the selected one of the data sets when the secondary game is triggered.

14. The gaming machine according to claim 13, wherein the secondary game is a progressive game and the plurality of award levels comprise at least one progressive level, and the plurality of data sets comprise parameters for defining an increment rate and reset value of the at least one progressive level according to which the control section calculates an amount of the at least one progressive level based on the bet contribution.

15. A method for conducting a game having a primary game and a secondary game in a system comprising a plurality of gaming machines, the method comprising the steps of:

providing a plurality of data sets, each data set having a different target investment amount;

calculating an average bet amount from bet contributions input to the plurality of gaming machines by players;

selecting one of the data sets as a function of the calculated average bet amount; and determining whether the secondary game is triggered once the target investment amount associated with the selected one of the data sets has been met, and if the secondary game is triggered, paying out a secondary game award to one of the players.

16. The method according to claim 15, wherein the secondary game has a plurality of award levels, the plurality of data sets define odds of winning the plurality of award levels based on the respective target investment amounts and a predetermined payout percentage and the step of determining includes the step of determining which of the plurality of award levels is won according to the odds defined by the selected one of the data sets when the secondary game is triggered.

17. The method according to claim 16, wherein the secondary game is a progressive game and the plurality of award levels comprise at least one progressive level, and the plurality of data sets comprise parameters for defining an increment rate and reset value of the at least one progressive level, the method further comprising a step for calculating an amount of the at least one progressive level based on the bet contributions from the gaming machines in accordance with the parameters.

* * * * *